US005405498A

United States Patent [19]

Pease

[11] Patent Number: 5,405,498

[45] Date of Patent: Apr. 11, 1995

[54] METHOD FOR IMPROVING PULP WASHING EFFICIENCY

[75] Inventor: Jacqueline K. Pease, Jacksonville, Fla.

[73] Assignee: Betz PaperChem, Inc., Jacksonville, Fla.

[21] Appl. No.: 80,910

[22] Filed: Jun. 22, 1993

[51] Int. Cl.[6] ..... D21C 5/02

[52] U.S. Cl. ..... 162/60; 162/72; 162/77; 162/82

[58] Field of Search ..... 162/5, 60, 72, 77, 82

[56] References Cited

U.S. PATENT DOCUMENTS

| | | | |
|---|---|---|---|
| 4,024,072 | 5/1977 | Shane et al. | 252/358 |
| 4,297,164 | 10/1981 | Lee | 162/60 |
| 4,444,621 | 4/1984 | Lindahl | 162/26 |
| 4,548,674 | 10/1985 | Hagerman et al. | 162/5 |
| 4,781,251 | 11/1988 | Nawe et al. | 166/274 |
| 4,810,328 | 3/1989 | Freis et al. | 162/60 |

FOREIGN PATENT DOCUMENTS 1270354 6/1990 Canada .

OTHER PUBLICATIONS

Blomberg, L., et al., "Organic Carry-Over in Kraft Pulp and Bleaching Discharges", Proceedings from TAPPI Pulping Conference, pp. 217–226 (1990).

Hise et al., "The Effect of Brown Stock Washing on the Formation of Chlorinated Dioxins and Furans During Bleaching", *TAPPI Journal,* 73(1):185–190 (1990).

Laxen, T., "Dynamic and Physical-Chemical Aspects of Sulphate Pulp Washing", *Pulp and Paper Canada,* 87(4):49–53 (1986).

*Primary Examiner*—W. Gary Jones

*Assistant Examiner*—Mark De Simone

*Attorney, Agent, or Firm*—Alexander D. Ricci; Richard A. Paikoff

[57] ABSTRACT

A process for enhancing pulp washing efficiency is disclosed. An anionic surfactant is added within the washing or pulping operation to enhance the removal of lignin and spent cooking chemicals from pulp.

10 Claims, No Drawings

METHOD FOR IMPROVING PULP WASHING EFFICIENCY

FIELD OF THE INVENTION

The present invention relates to a method for increasing the efficiency of pulp washing by decreasing the tendency for lignin to remain in the fibrous mat after washing.

BACKGROUND OF THE INVENTION

The manufacture of paper from wood requires many complex steps, including the formation of pulp fiber from wood chips. This process takes place in a digester, where wood chips are cooked at high temperature with sodium sulphide and sodium hydroxide in order to break down and solubilize the lignin, so that it can be separated from the wood pulp. The most prominent by-product of the process is kraft lignin, a complex three-dimensional material based on repeating phenol propane units.

The lignin and spent cooking chemicals are contained in the liquid fraction, often referred to as black liquor, of the brown stock.

Additional by-products found in the black liquor include wood pitch and hemicelluloses (low molecular weight polysaccharides). When pine is used, crude tall oil and turpentine become very important by-products.

Following the digester, the black liquor (containing organics, mostly lignin, and inorganic spent cooking chemicals) is separated from the wood pulp in a process commonly known as brown stock washing. Rotary drum washers placed in series are commonly used to wash brown stock. Generally, these drums are made up of different washing zones. The first washing step within a drum is usually dilution/thickening, where the brown stock is diluted with liquid which is cleaner than the liquid within the brown stock. After the stock is thickened on the vacuum drum, a second washing step of displacement is usually conducted. In the displacement phase, liquid which is cleaner than the mat of pulp is applied to the mat surface via showers and pulled through the pulp mat to displace the dirty liquid held within it. Kraft brown stock washing can also be conducted with variations of this washing technique. Other washing methods include pressure washers, which use pressure rather than vacuum, and belt washers, which use displacement.

Brown stock washing is important to the pulp mill operation. Digester cooking chemicals are recovered for reuse during washing. Pulp mills also burn the organics for their heating value. Therefore, the efficient collection of organics from the pulp is very important to an effective pulp mill operation. Bleaching, which often follows brown stock washing, is more efficient when the brown stock washers remove the most by-product solids possible.

The brown stock washing phase is also especially important environmentally. The effluent from bleaching is discharged from the mill; this effluent contains chlorinated organics, which can be toxic. Toxic substances which are currently of concern include dioxins and furans, specifically 2,3,7,8-tetradichlorodibenzo-p-dioxin and 2,3,7,8-tetrachlorodibenzofuran, absorbable organic halogens, and color. Increased organics removal in brown stock washing has been shown to decrease the environmental impact of bleaching.

Brown stock washing is an important aspect of pulp mill operation. Specifically, the washing of organics from pulp is becoming increasingly important. In bleached processes, enhanced organic removal would reduce bleaching chemical consumption, costs, and environmental problems associated with effluent discharge of chlorinated organics. In unbleached processes, enhanced organics removal in washing should decrease runnability problems associated with excess lignin in pulp, such as reduced retention aid performance.

DETAILED DESCRIPTION OF THE INVENTION

The present invention relates to a process for enhancing pulp washing efficiency by decreasing the tendency of lignin to remain with the pulp fraction during washing. In this method, anionic surfactants are added within the washing or pulping operation to enhance the removal of lignin. These surfactants are ethosulfate compounds of the following general structure:

$$R—(OCH_2CH_2)_nOSO_3M$$

where R is alkyl, aryl or alkylaryl, M is H or a water soluble cation, (e.g., $Na^+$, $NH_4^+$, $K^+$) and n is from about 1–30.

The water soluble cation may be any positively charged cation. The R group may have from about 8 to 26 carbons when R is alkyl, with about 12–16 carbons preferred; when R is alkylaryl, the chain length may be from about 6 to 14 carbons with benzene as the aryl group, with 8–9 carbons preferred.

The treatment may be added at any point from the digester to the brown stock washers (and the decker, which is a washer that follows but is usually separated from the brown stock washers) in Kraft, or sulphate systems for both hardwood and softwood. In the digester, the temperature of treatment is from about 200° to 350° F., with a pH of about 12–13. In the washers, the temperature range of treatment is from about 100°–200° F., with a pH of about 8–13. It is expected that the method of the present invention would also be effective in the washing processes that occur within a bleaching plant.

It will be appreciated that ethosulfate compounds such as alkyl phenol ethosulfates and alcohol ethosulfates may be utilized in-the present invention. Treatment levels of from about 0.1 to 1000 parts of anionic surfactant per million parts of pulp may be effective. Chemically prepared pulp (e.g., sulphate, sulfite) as well as mechanically and semi-chemically prepared pulp may all benefit from the present invention.

The invention will be further understood by reference to the following examples.

Kraft black liquor and unbleached Kraft pulp were collected from a softwood brown stock washer and mixed so that the pulp constituted 0.75% of the mixture (based on oven dry fiber). The stock was divided into separate samples, and the pH of each sample was adjusted to the desired level. Following an incubation period of 30 minutes at 71° C., the samples were filtered. The absorbance of the filtrate was measured at a wavelength of 700 nm, (chosen to be able to measure the broadest array of concentrations of black liquor with minimal dilution) and the Kappa number of the pulp mat was measured as well.

The absorbance was used to measure the solution color, a high color relating to more lignin remaining in the filtrate. The Kappa number measurement is a well-established test method used in the paper industry to determine the lignin content of pulp. In this method, pulp is bleached with an excess and known quantity of potassium permanganate. The unused permanganate, determined with a titration using thiosulfate, is used to report the Kappa number, which is directly related to the level of lignin remaining with the pulp.

TABLE 1

Effect of pH on Pulp Mat Kappa Number and Filtrate Absorbance Using Softwood Kraft Pulp and Black Liquor at 71° C.

| pH | Filtrate Absorbance | Kappa Number |
|---|---|---|
| 12 | 11.3 | 57 |
| 11 | 10.5 | 76 |
| 10 | 7.1 | 211 |
| 9 | 4.0 | 271 |

The above results demonstrate that the amount of lignin remaining with the mat (as shown by Kappa number) increases with decreasing pH. The filtrate absorbance decreased as the Kappa number of the mat increased since the lignin, the main color-producing substance in black liquor, remained with the mat instead of the liquid phase. Therefore, filtrate absorbance may be used in place of mat Kappa number to determine where the lignin is, either in the fiber mat or with the liquid phase.

The above experiment was repeated replacing the black liquor with a solution containing 5000 ppm Kraft lignin (Indulin AT, by Westvaco Corp.), 100 ppm $Ca^{+2}$, and enough caustic to raise the pH to 12. The results are found in Table 2.

TABLE 2

Effect of pH on Mat Kappa Number and Filtrate Absorbance Using Kraft Lignin (Indulin AT) at 71° C.

| pH | Absorbance | Kappa Number |
|---|---|---|
| 12 | 2.80 | 13 |
| 9 | 0.38 | 120 |

Table 2 illustrates that the use of Indulin AT is an acceptable model for testing in place of black liquor as the lignin also has a tendency to remain with the fiber when the pH is decreased. The Indulin AT is also more consistent than black liquor, as black liquor may vary with age and sample location.

In order to determine whether the addition of pulp was needed for testing, solutions containing 5000 ppm Indulin AT and 100 ppm $Ca^{+2}$, which did not contain pulp fiber, were brought up to pH 12 to dissolve the Indulin AT. The pH was then lowered to the desired level, and the sample was incubated for 30 minutes at the desired temperature. Following incubation, the samples were filtered, and the filtrate brought back up to pH 12 prior to measuring its absorbance at 700 nm.

TABLE 3

Effect of Temperature on Lignin Washability (Filtrate Absorbance vs. pH and Temperature)

| 71° C. | | 50° C. | | 23° C. | |
|---|---|---|---|---|---|
| pH | Blank | pH | Blank | pH | Blank |
| 12.0 | 2.35 | 10.0 | 2.15 | 9.2 | 2.33 |
| 10.0 | 2.52 | 9.0 | 2.18 | 7.5 | 2.40 |
| 9.8 | 2.52 | 8.5 | 1.24 | 6.5 | 1.46 |
| 9.5 | 0.74 | 8.0 | 0.96 | 6.0 | 0.53 |

TABLE 3-continued

Effect of Temperature on Lignin Washability (Filtrate Absorbance vs. pH and Temperature)

| 71° C. | | 50° C. | | 23° C. | |
|---|---|---|---|---|---|
| pH | Blank | pH | Blank | pH | Blank |
| 9.0 | 0.58 | 7.0 | 0.30 | 5.0 | 0.07 |
| 8.0 | 0.27 | 6.0 | 0.16 | 4.0 | 0.07 |

By comparing the results in Table 3 for 71° C. with those of Table 2, it is apparent that the inclusion of the fiber is not necessary to measure the reduction of lignin in the filtrate with decreasing pH.

EXAMPLE 1

Based on the above results, a test method was developed to screen materials in order to determine if they could decrease the tendency of the lignin to be filtered out of solution. The procedure consisted of making a solution of 5000 ppm Indulin AT, 100 ppm $Ca^{+2}$, 1000 ppm treatment actives, and enough sodium hydroxide to bring the pH to 12 and dissolve the Indulin AT. The solution pH was then decreased with hydrochloric acid to pH 6 and allowed to incubate at room temperature for 30 minutes prior to filtration. After filtration, the filtrate pH was raised to 12 and the absorbance was measured at 700 nm. The materials used in the following examples are described in Table 4. The ethosulfates in this table are commercially available from Rhone Poulenc, Inc. and Vista Chemical Co.

TABLE 4

Products Tested

| Tradename | Description |
|---|---|
| Alipal C0433 | nonyl phenol ethosulfate, sodium salt |
| Alipal C0436 | nonyl phenol ethosulfate, ammonium salt |
| Alipal EP110 | nonyl phenol ethosulfate, ammonium salt |
| Alipal EP115 | nonyl phenol ethosulfate, ammonium salt |
| Alipal EP120 | nonyl phenol ethosulfate, ammonium salt |
| Alfonic ® 1412S | linear alcohol ethosulfate, sodium salt |
| Alipal CD128 | linear alcohol ethosulfate, ammonium salt |
| Witconte D510 | sodium 2-ethylhexyl sulfate |
| Poly-Tergent ® | alkoxylated linear alcohol carboxylic acid |
| Emcol ® CBA50 | poly(oxy-1,2-ethanediyl), -(carboxymethyl) -(tridecyloxy)-branched, sodium salt |
| Emcol ® CNP120 | poly(oxy-1,2-ethanediyl), -(carboxymethyl) -(nonylphenoxy)-, sodium salt |
| Gafac ® RE610 | polyoxyethylene nonyl phenyl ether phosphate |
| Pluronic ® F108 | ethoxy/propoxy/ethoxy block copolymer |
| Tergitol ® 15-S-7 | secondary alcohol ethoxylate, 7 mole EO |
| Igepal C0530 | nonyl phenol ethoxylate, 6 mole EO, HLB = 10.5 |
| Igepal C0880 | nonyl phenol ethoxylate, 30 mole EO, HLB = 17.2 |
| Floerger ® 45.20 | 80% dimethyldiallyl ammonium chloride (DMDAAC)/20% acrylamide copolymer |
| Goodrite ® K732 | polyacrylate, MW = 5100 |
| Carbopol ® 941 | polyacrylate, MW = 1,250,000 |
| Foam-Trol ® 275 | defoamer, containing PEG 100, ethylenebis stearamide, oil and silicone oil |
| Polyox ® N60K | polyethylene oxide, MW = 2,000,000 |

TABLE 5

Effect of Anionic Surfactants (Filtrate Absorbance)

| Material | Absorbance |
|---|---|
| Blank | 0.53 |
| Alipal C0433 | 2.69 |
| Alipal C0436 | 2.50 |
| Alipal EP110 | 1.92 |
| Alipal EP115 | 1.90 |
| Alipal EP120 | 2.14 |
| Alfonic 1412S | 2.37 |
| Alipal CD128 | 1.32 |

TABLE 5-continued

| Effect of Anionic Surfactants (Filtrate Absorbance) | |
|---|---|
| Material | Absorbance |
| Witconate D510 | 0.87 |
| Poly-Tergent CS1 | 1.05 |
| Emcol CBA50 | 0.32 |
| Emcol CNP120 | 0.18 |
| Gafac RE610 | 2.19 |

The data in Table 5 show that the majority of anionic surfactant types decreased the tendency of lignin to remain with the filter paper (as shown by high filtrate absorbances). The ethosulfates were unexpectedly superior to the alkyl sulfate and the carboxylated surfactants.

Table 6 contains the results of using nonionic surfactants as well as typical materials that may be found in brown stock washers. The effect of a combination of alkylphenol ethoxylate and polyacrylate (Igepal C0530/Goodrite K732), a combination taught by Freis et al. U.S. Pat. No. 4,810,328, was also tested at a 1:1 ratio.

TABLE 6

| Effect of Other Materials (Filtrate Absorbance) | |
|---|---|
| Material | Absorbance |
| Blank | 0.53 |
| Pluronic F108 | 0.12 |
| Tergitol 15-S-7 | 0.06 |
| Igepal C0530 | 0.13 |
| Igepal C0880 | 0.13 |
| Floerger 45.20 | 0.03 |
| Polyox N60K | 0.06 |
| Igepal C0530/Goodrite K732 | 0.95 |
| Foamtrol 275 | 1.61 |
| Goodrite K732 | 2.03 |
| Carbopol 941 | 1.59 |

As shown in Table 6, the combination found in Freis et al. '328 gave relatively little improvement as compared with the untreated sample.

EXAMPLE 2

In this example, the same procedure was followed as for Example 1, with the exception that the pH was decreased to various levels in order to determine the pH range where the lignin began staying with the filter paper. Materials which had shown some effect in Example 1 were used for this testing. The results are reported in Table 7.

TABLE 7

| pH Range in which Lignin remains with Filter Paper (Filtrate Absorbance) | | | | | |
|---|---|---|---|---|---|
| | pH | | | | |
| Product | 6.0 | 5.5 | 5.0 | 4.5 | 4.0 |
| Untreated | 0.53 | 0.16 | 0.07 | 0.04 | 0.07 |
| Goodrite K732 | 2.03 | 0.98 | 0.25 | | |
| Carbopol 941 | 1.59 | | 0.10 | | |
| Foamtrol 275 | 1.61 | | 0.33 | | |
| Alipal C0433 | 2.69 | | 2.05 | 0.08 | 0.06 |
| Alipal C0436 | 2.50 | 1.65 | 0.20 | | |
| Alipal EP110 | 1.92 | 2.24 | 0.17 | | |
| Alipal EP115 | 1.90 | | 1.76 | 0.04 | 0.04 |
| Alipal EP120 | 2.14 | 1.92 | 0.20 | | |
| Alfonic 1412S | 2.37 | 2.18 | 1.34 | 0.58 | 0.26 |
| Alipal CD128 | 1.32 | 0.37 | 0.09 | | |
| Polytergent CS1 | 1.05 | | 0.21 | | |
| Gafac RE610 | 2.19 | 0.31 | 0.09 | | 0.08 |

Table 7 illustrates the effectiveness of the ethosulfates as compared to the carboxylated and phosphated surfactants. The ethosulfates are also more effective as a class than the polyacrylates and defoamer. The above table also demonstrates that the sodium salts are more preferred than the ammonium salts with similar ethosulfates. For instance, Alipal C0433 and Alipal C0436, both nonyl phenol ethosulfates with the same level of ethoxylation, behave differently, the sodium salt being the more effective. A similar situation exists between two alcohol ethosulfates, Alfonic 1412S and Alipal CD128, the sodium salt (Alfonic 1412S) being more effective. However, ammonium salts can still be effective, as is apparent with a review of ammonium ethosulfate data with greater degrees of ethoxylation.

EXAMPLE 3

In order to further illustrate the effectiveness of ethosulfates, Alfonic 1412S was used with fiber. The same test method as Example 2 was used, with fiber being added. The experiments were conducted at 71° C. and pH 9. The results are contained in Table 8.

TABLE 8

| | Results with Fiber | |
|---|---|---|
| Treatment | Absorbance | Kappa Number |
| Untreated | 0.4 | 120 |
| Alfonic 1412S | 0.9 | 79 |

These results indicate that Alfonic 1412S decreases the lignin content in the fiber mat, as shown by the Kappa number.

EXAMPLE 4

In this example, actual black liquor was used in place of Indulin AT, and the experiment was carried out as in Example 3, except that the pH set for incubation was 10. The results are contained in Table 9.

TABLE 9

| | Results with Black Liquor | |
|---|---|---|
| Treatment | Absorbance | Kappa Number |
| Untreated | 7 | 211 |
| Alfonic 1412S | 8 | 200 |

The results in Table 9 show that ethosulfates such as Alfonic 1412S gave an improvement over an untreated system.

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

I claim:

1. A method for removing lignin and spent cooking chemicals from pulp which comprises adding within the washing or pulping operation an amount, effective for the purpose of an ethosulfate compound of the formula:

$$R—(OCH_2CH_2)_nOSO_3M$$

wherein R is alkyl, aryl or alkylaryl, M is H or a water soluble cation, and n is from about 1–30.

2. The method as recited in claim 1 wherein said water soluble cation is selected from the group consisting of $Na^+$, $NH_4^+$, $K^+$.

3. The method as recited in claim 1 wherein said ethosulfate compound is an alkyl phenol ethosulfate.

4. The method as recited in claim 3 wherein said alkyl phenol ethosulfate is a nonyl phenol ethosulfate.

5. The method as recited in claim 1 wherein said ethosulfate compound is an alcohol ethosulfate.

6. The method as recited in claim 1 wherein the removal of lignin and spent cooking chemicals occurs at a temperature of from about 100°–350° F.

7. The method as recited in claim 1 wherein the removal of lignin and spent cooking chemicals occurs at a pH of from about 8–13.

8. The method as recited in claim 1 wherein from about 0.1 to 1000 parts of ethosulfate compound per million parts of pulp is added within the washing or pulping operation.

9. The method as recited in claim 1 wherein the pulp is prepared by chemical, mechanical or semi-chemical means.

10. A method for removing lignin and spent cooking chemicals from pulp which consists essentially of adding within the washing or pulping operation an amount, effective for the purpose of an ethosulfate compound of the formula:

$$R—(OCH_2CH_2)_nOSO_3M$$

wherein R is alkyl, aryl or alkylaryl, M is H or a water soluble cation, and n is from about 1–30, the pulp prepared by chemical, mechanical or semi-chemical means.

* * * * *